US008517350B2

(12) United States Patent
Tsai et al.

(10) Patent No.: US 8,517,350 B2
(45) Date of Patent: Aug. 27, 2013

(54) VENTURI APPARATUS FOR POURING AND AEREATING BEVERAGES

(75) Inventors: Leo Tsai, Tainan (TW); Frank O. Chiorazzi, Salinas, CA (US); F. David LaRiviere, Monterey, CA (US)

(73) Assignee: Franmara, Inc., Salinas, CA (US)

( * ) Notice: Subject to any disclaimer, the term of this patent is extended or adjusted under 35 U.S.C. 154(b) by 0 days.

(21) Appl. No.: 13/216,718

(22) Filed: Aug. 24, 2011

(65) Prior Publication Data

US 2013/0051174 A1 Feb. 28, 2013

(51) Int. Cl.
*B01F 3/04* (2006.01)
*B65D 5/72* (2006.01)
*B67D 7/76* (2010.01)

(52) U.S. Cl.
USPC ..... 261/76; 222/566; 222/190; 261/DIG. 75

(58) Field of Classification Search
USPC ..... 366/366, 261, 222, 99, 137; 222/566, 222/190; 261/76, DIG. 75
See application file for complete search history.

(56) References Cited

U.S. PATENT DOCUMENTS

| | | | | | |
|---|---|---|---|---|---|
| 3,656,495 | A * | 4/1972 | Noren | 137/832 |
| 3,822,217 | A | 7/1974 | Rogers | |
| 4,224,158 | A | 9/1980 | Molvar | |
| 4,308,138 | A | 12/1981 | Woltman | |
| 4,522,151 | A | 6/1985 | Arbisi et al. | |
| 4,706,720 | A * | 11/1987 | Pattison et al. | 141/327 |
| 5,298,198 | A | 3/1994 | LaCrosse | |
| 5,370,069 | A | 12/1994 | Monroe | |
| 5,417,860 | A * | 5/1995 | Kay | 210/472 |
| 5,514,267 | A | 5/1996 | Machiya et al. | |
| 5,645,223 | A | 7/1997 | Hull et al. | |
| 6,279,598 | B1 | 8/2001 | Boticki et al. | |
| 6,293,294 | B1 | 9/2001 | Loeb et al. | |
| 6,395,175 | B1 | 5/2002 | Gao et al. | |
| 6,568,660 | B1 * | 5/2003 | Flanbaum | 261/76 |
| 7,156,377 | B2 | 1/2007 | Chapman et al. | |
| 7,299,743 | B2 | 11/2007 | Moore | |
| 7,614,614 | B2 | 11/2009 | Sabadicci et al. | |
| D614,443 | S | 4/2010 | Federighi | |
| 8,245,882 | B1 * | 8/2012 | Federighi | 222/190 |
| 8,251,352 | B2 * | 8/2012 | Chiorazzi et al. | 261/76 |
| D677,524 | S * | 3/2013 | Agarwal et al. | D7/398 |
| 2004/0036185 | A1 | 2/2004 | Garcia | |
| 2004/0113288 | A1 | 6/2004 | Korzeniowski | |
| 2007/0187848 | A1 | 8/2007 | Sabadicci et al. | |
| 2007/0196249 | A1 | 8/2007 | Fridman et al. | |
| 2007/0256568 | A1 | 11/2007 | Nudi et al. | |
| 2009/0160072 | A1 * | 6/2009 | Chiorazzi | 261/76 |

OTHER PUBLICATIONS

U.S. Appl. No. 12/877,718, filed Sep. 8, 2010, Chiorrazzi et al.

* cited by examiner

*Primary Examiner* — Tony G Soohoo
*Assistant Examiner* — Anshu Bhatia
(74) *Attorney, Agent, or Firm* — LaRiviere, Grubman & Payne, LLP

(57) ABSTRACT

An improved venturi apparatus for the incorporation of air into a liquid as it is poured from a bottle. The preferred embodiment of the invention comprises an entry section, a constricted intermediate section, and an outflow section. Lateral tubes extend from the constricted intermediate section so as to form an acute angle relative to both the central and cross-sectional axes of the constricted intermediate section, thereby preventing leakage of liquid out through the lateral tubes during use and subsequent handling. The device includes a ventilation tube with a ventilation cavity for capturing backwash of the liquid as pouring is terminated, and for preventing leakage from the ventilation port.

6 Claims, 7 Drawing Sheets

VENTURI APPARATUS FOR POURING AND AEREATING BEVERAGES

CROSS-REFERENCE TO RELATED DOCUMENTS

This non-provisional application is related to U.S. application Ser. No. 12/045,361, filed Mar. 10, 2008; Ser. No. 61/243,900, filed Sep. 18, 2009; and Ser. No. 12/877,718 filed Sep. 8, 2010.

BACKGROUND OF THE INVENTION

The principles of a venturi apparatus are well known in the art. Fluid flowing in a tube that passes through a constricted region experiences both an increase in velocity and simultaneous drop in pressure. The placement of an opening along the area of constriction produces a suction effect due to the decreased pressure of the fluid flowing in that portion of the tube. This principle has been exploited for numerous applications, including flow measurement and the introduction of additional fluids into an existing stream.

As recognized in the prior art, a simple venturi apparatus may be employed to facilitate aeration of a liquid such as wine. One such prior art design consists of a vertically oriented venturi device having a first funnel section connected to a constricted intermediate section that is in turn connected to a second funnel-type frusto-conical section. Two sidearm passageways extend horizontally from the constricted intermediate section. Liquid poured into the first funnel section is channeled into the constricted intermediate section, where it increases in velocity and decreases in pressure. This creates a suction effect that draws in air through the sidearm passageways. The air is thus incorporated into the liquid, which exits the device through the second funnel-type frusto-conical section. (See U.S. Patent Application Publication No. US2007/0187848A1 ('848)).

Another prior art design also utilizes the venturi principle for simultaneously pouring liquid from a container and mixing air into the liquid. Thus, the pourer of U.S. Pat. No. 6,568,660 B1 may be used for simultaneously pouring wine from a bottle and decanting the wine.

However, problems exist in both prior art designs. Notably, the devices are prone to leaking liquid out through air passageways. This is especially likely to occur when a large amount of liquid is poured through the devices. In order to minimize the likelihood of leakage, a user must maintain the device described in the '848 publication in a near perfect vertical orientation during usage, and in a carefully determined angle from vertical in the case of the pourer of the '660 patent. And even so, this may not ensure that leakage does not occur, especially when larger quantities of liquid are poured, or when pouring is terminated and wine remaining in the bottle rebounds into the bottleneck as it is returned to an upright position.

The prior art device is thus unpredictably prone to leakage of liquid, which can cause many additional problems for the user. A leaked beverage, particularly as with red wine, can result in stains that are difficult to clean. Such leakage also renders the device itself slippery and difficult to handle, in addition to soiling the user's hand. Moreover, beverages such as fine wine can be quite expensive, and any loss due to leakage constitutes a cost that must be borne by the user.

SUMMARY OF THE INVENTION

The present invention is directed to an improvement to the venturi apparatus for simultaneously pouring and aereating a liquid, such as wine, from a container as described in U.S. application Ser. No. 12/877,718, which is incorporated by reference as it fully set forth herein. The improved apparatus of the present invention comprises a conduit through which a first fluid flows, having a constricted intermediate region. One or more lateral tubes for introducing a second fluid at the constricted intermediate region are formed at a substantially acute angle relative to the direction of flow of the first fluid through the constricted intermediate region. The placement of lateral angles of the lateral tubes is selected to maximize flow of the first liquid from the container without overflowing through them.

In addition, the present invention includes a ventilation or breather tube, extending into the neck of the bottle, and having the diameter of a section or portion of its length enlarged to, at once, facilitate improved pouring performance and to capture backwashed wine as it rebounds into the neck of the bottle when pouring is terminated. This ventilation cavity, comprising a larger diameter section of the ventilation tube, greatly reduces or even eliminates spillage through the ventilation port of the ventilation tube.

The entry section formed to fit into the opening of the container that is fluidly connected to a constricted intermediate section, which in turn is fluidly connected to an outflow section. Lateral tubes extend from the constricted intermediate section at acute angles relative to the central and orthogonal axes of the constricted intermediate section, and are fluidly continuous with the exterior. The lateral tubes facilitate the introduction of air into liquid flowing in the device, and their angled orientation prevents leakage of liquid through the tubes.

The portion of the entry section that fits into the mouth or opening of the bottle is extended to provide infrastructure for a ventilation or breather tube having an enlarged section for capturing backwashed wine as it rebounds into the neck of the bottle as the bottle is returned to an upright position after pouring. In addition, an optional outlet cover is provided for food service applications.

DETAILED DESCRIPTION OF THE DRAWINGS

Figure 1:
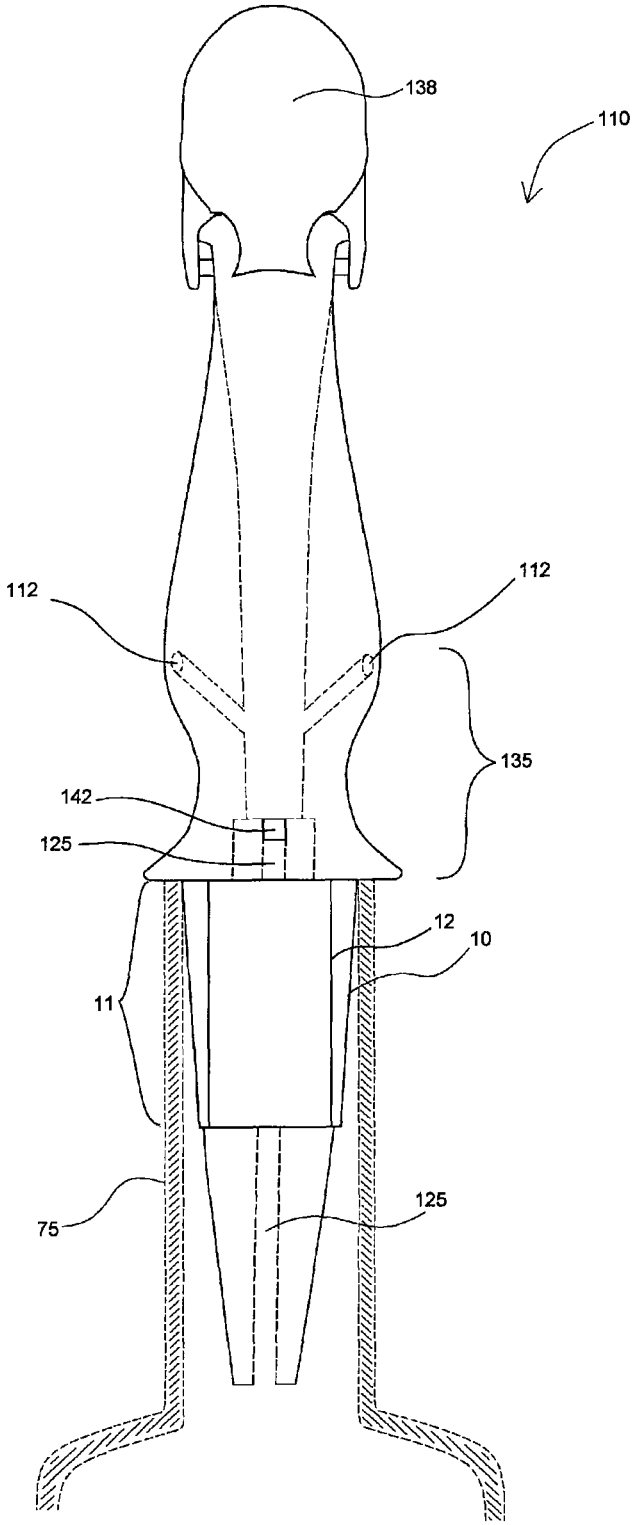
FIG. 1 is a top view cross section of a first embodiment of the present invention.

The present invention provides an improved venturi apparatus for mixing two fluids. In an embodiment of the present invention, apparatus 110 comprises a conduit through which a first fluid flows, the conduit having a constricted intermediate region 113. One or more lateral tubes 112 for introducing a second fluid at the constricted intermediate region 113 are preferably formed at a substantially acute angle from the constricted intermediate section 113 towards the outflow section 54.

The present invention is drawn to an improved venturi apparatus for facilitating the aeration of a liquid beverage such as wine.

Entry section 114 has an annular cross-section for conducting the flow of the liquid beverage to the constricted intermediate region 113, when pouring liquid through the device 110 from a bottle 75. The inner diameter of entry section 114 is substantially uniform along the axis and direction of liquid flow. The outer diameter of the entry section 10 (seen in FIG. 1) is tapered to be adapted to fit into the top opening of a bottle 75, and may comprise or include a soft material 10 for providing a seal between the bottle 75 and the device 110.

Opposed lateral tubes 112 are fluidly connected to constricted intermediate section 113, extending from section 113 so as to form an acute angle, preferably 45 degrees relative to the central axis 110 and the outflow section 54, and are fluidly continuous with the exterior of the device 110. As liquid is poured through the device 110, air is drawn into the liquid via the lateral tubes 112. The upward angled orientation of the lateral tubes prevents liquid from leaking out through the tubes, during both actual use and subsequent handling.

Outflow section 50 is fluidly connected to the constricted intermediate section 113 and the entry section 114. Outflow section 50 has a diameter at the constricted intermediate section 113 that is smaller than that at the exit end of the device 54, this being found to facilitate enhanced mixing of air with liquid prior to exiting the device. The exit end 54 of the device may have any shape for efficiently and conveniently guiding the aereated liquid to another container, such as a wine glass. In addition, an optional outlet cover 138 is provided as usually required for food service applications.

In operation, the entry section 11, 114 and ventilation tube 125 are inserted into the top of a bottle 75 up to the rim 25, where liquid to be aerated is poured into entry section 114, and thereby channeled into constricted intermediate section 113. As the liquid passes through constricted intermediate section 113, air is drawn into the liquid through the lateral tubes 112. The aerated liquid exits the device through the outflow section 50.

FIG. 1 is a top view cross section of a first embodiment of the present invention. Ventilation or breather tube 125 is disposed along the top of entry section 114. Entry section 11, and 114 are extended into the neck of bottle 75 to provide infrastructure for ventilation tube 125, and preferably includes liquid seal coating or sleeve 10. Sleeve 10 can be made of any deformable elastomer material having a suitable durometer for forming a liquid seal with the inner surface of the bottle opening and which is safe for food service applications. Bottle 75 is presented here for illustrative purposes only and forms no part of the present invention.

Tube 125 may be formed to fit within entry section 114 as a separate structure, or in conjunction with coating 10. If formed with coating 10, tube 125 can be constructed as a channel with entry section 114 enclosed by the wine surface of coating 10 at section 11.

The function of ventilation tube 125 is to facilitate flow of the liquid from the bottle through the device 110 by providing an airway into the bottle as the wine is poured therefrom. The length and diameter of tube 125 controls the liquid flow rate which, in turn, affects the aeration of the liquid. In general, the rate increases as the length of ventilation tube 125 extends into the neck of the bottle 75.

The diameter of ventilation tube 125 and lateral tubes 112 should be selected to avoid backwash and leakage from ventilation port 142 while the liquid is poured through the device 110, particularly as pouring first begins or is ending. Typically, for a device having an overall length of approximately 185 mm, the ventilation tube will have a length of approximately 80 mm, where entry section 114 is approximately 40 mm in length. The diameter of entry section 114 tapers from a maximum of approximately 23 mm, to a minimum of approximately 17 mm for insertion into a typical wine bottle opening.

Figure 2:
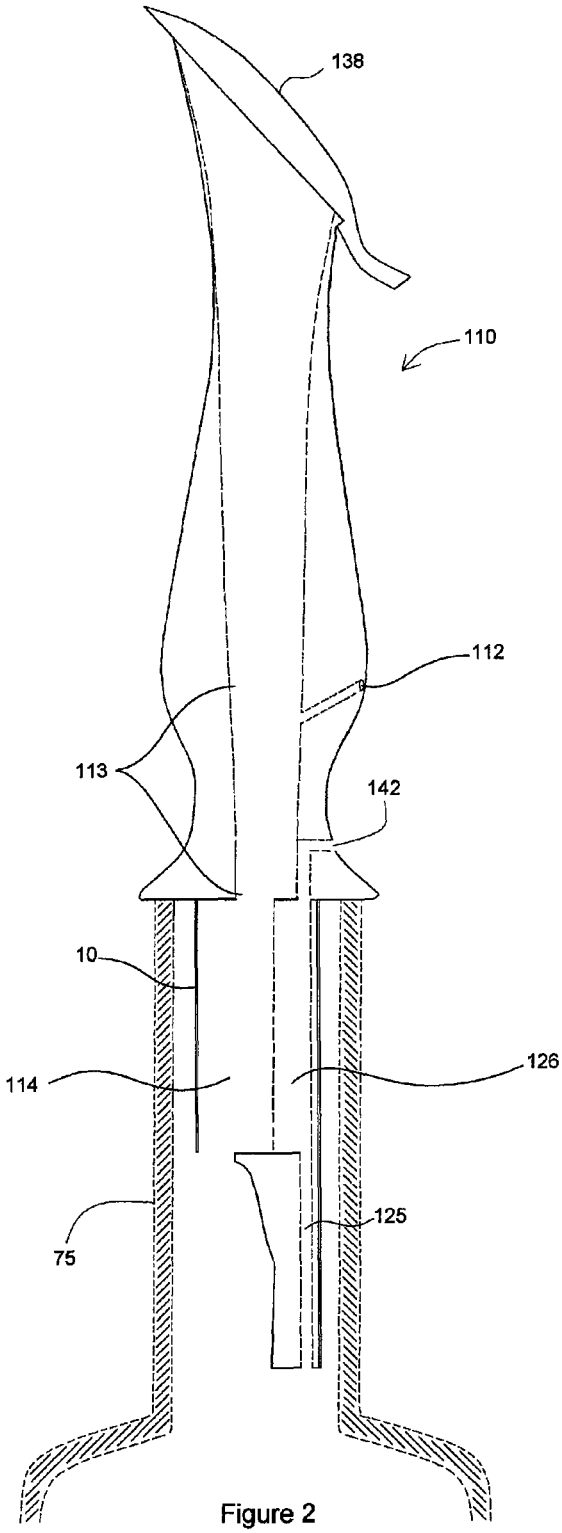
FIG. 2 is a side view cross section of the embodiment of FIG. 1.

FIG. 2 shows an enlarged section of the ventilation tube 125. The enlarged section, or ventilation tube cavity 126 is located between the distal end of the ventilation tube 125 and the ventilation port 142 and improves the performance of the device. The ventilation tube 125 extends internally from the end of the ventilation tube 125 through to the ventilation port 142. When pouring, this ventilation tube 125 allows air to pass into the bottle, and allows air to easily exit the bottle via the ventilation port when tilted back upright. The ventilation tube cavity 126 allows for a smoother and higher volume pour, as well as further reducing the likelihood of leakage from the lateral tubes 112 during use.

Figure 3:
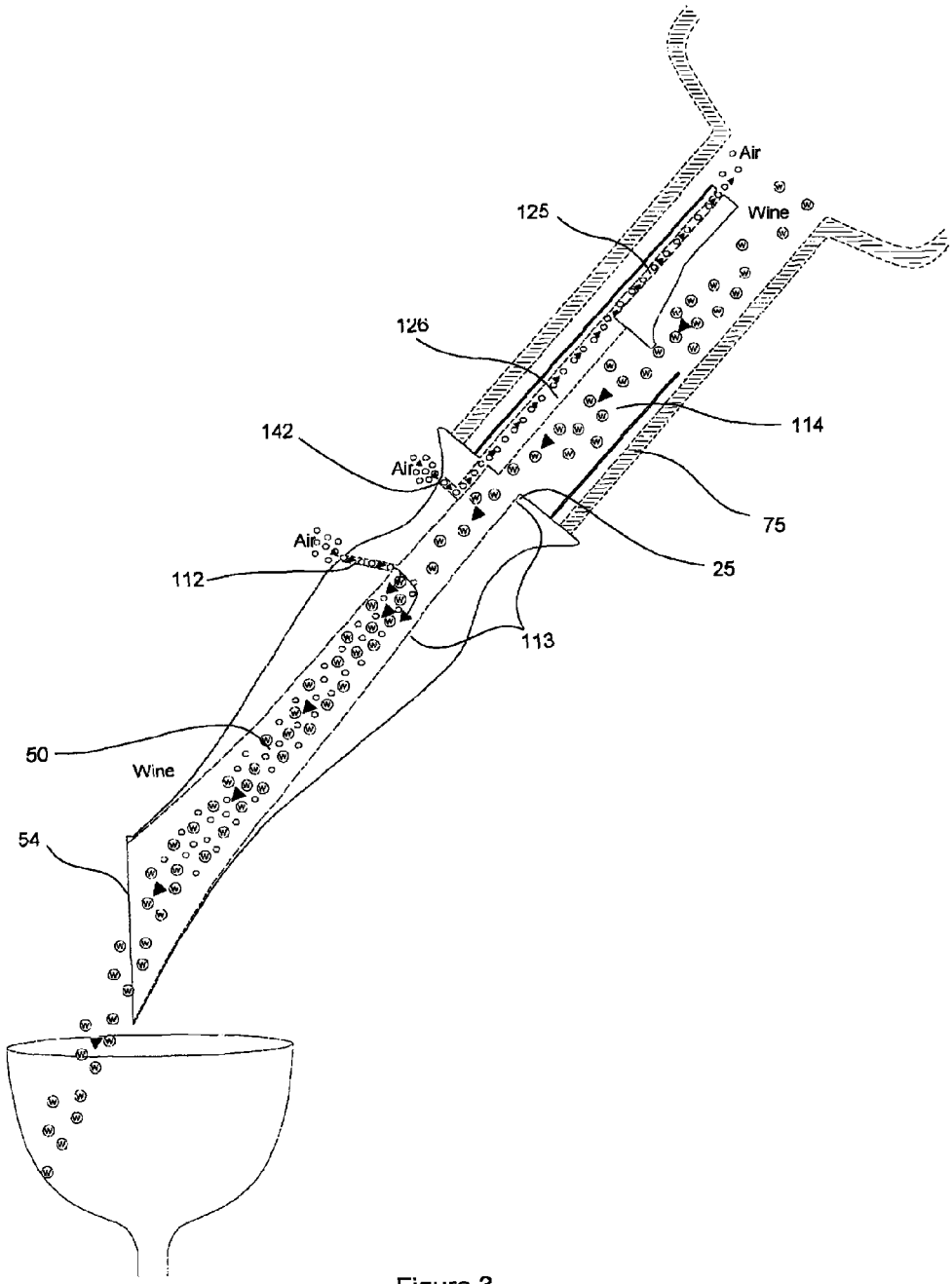
FIG. 3 is a lateral cross section of the device during a pour.
Figure 5:
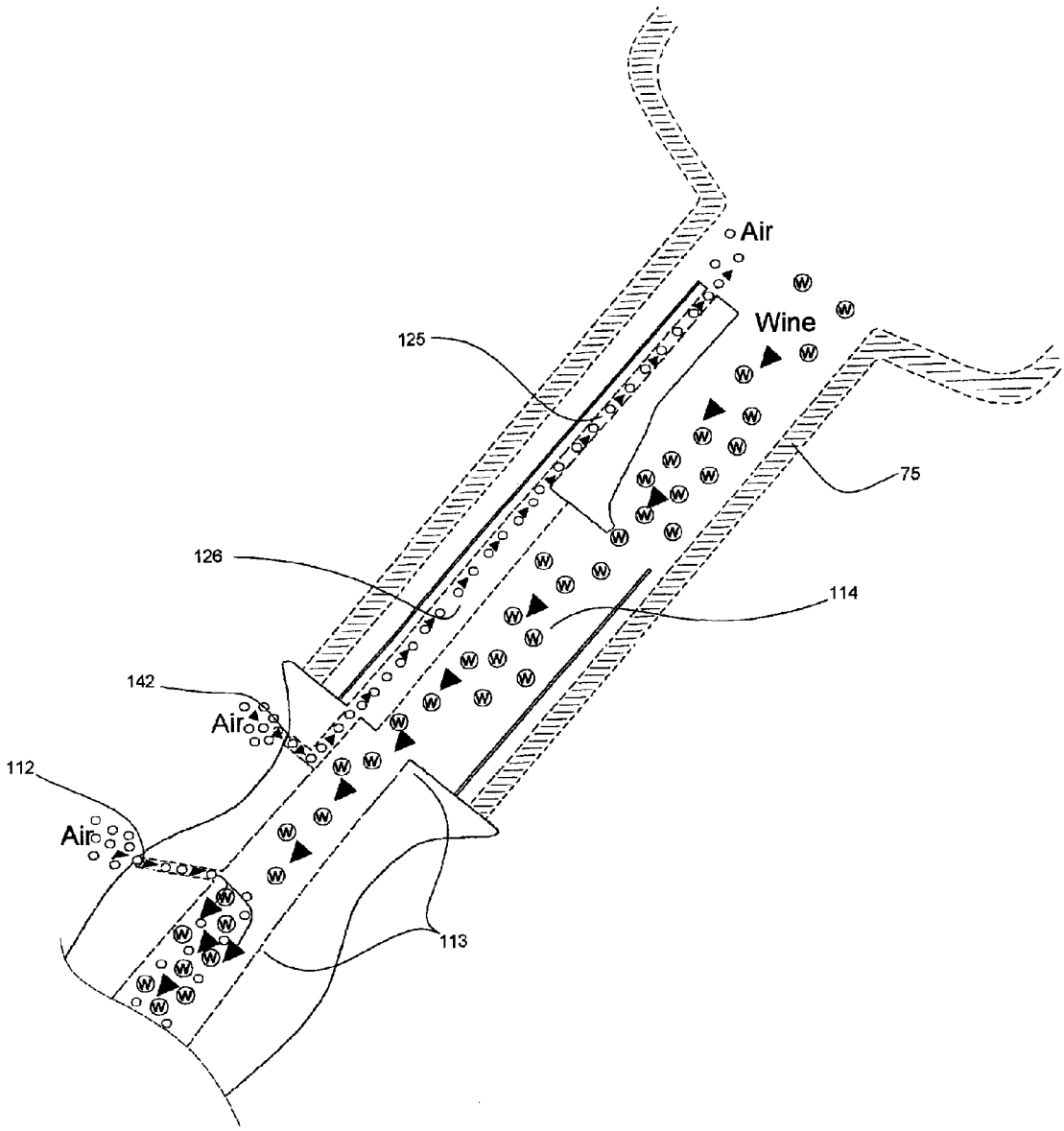
FIG. 5 is a magnified view of portions FIG. 3.

FIG. 3 is a lateral cross section of the device during a pour. FIG. 5 is a magnified view of portions FIG. 3. As the bottle 75 is tilted at a downward angle, the first fluid, preferably liquid wine shown as circled 'w's, flows from the bottle into the entry section 114, then into the constricted intermediate section 113. As this is occurring, the second fluid, such as air, flows into the ventilation port 142 and through the ventilation cavity 126, then into the ventilation tube 125 and finally into the bottle 75. As the wine flows past the lateral tubes 112, air is mixed with the wine as it is drawn into the device via the later tubes 112 at the constricted intermediate section 113, and aerates the wine as it flows through the device.

Figure 4:
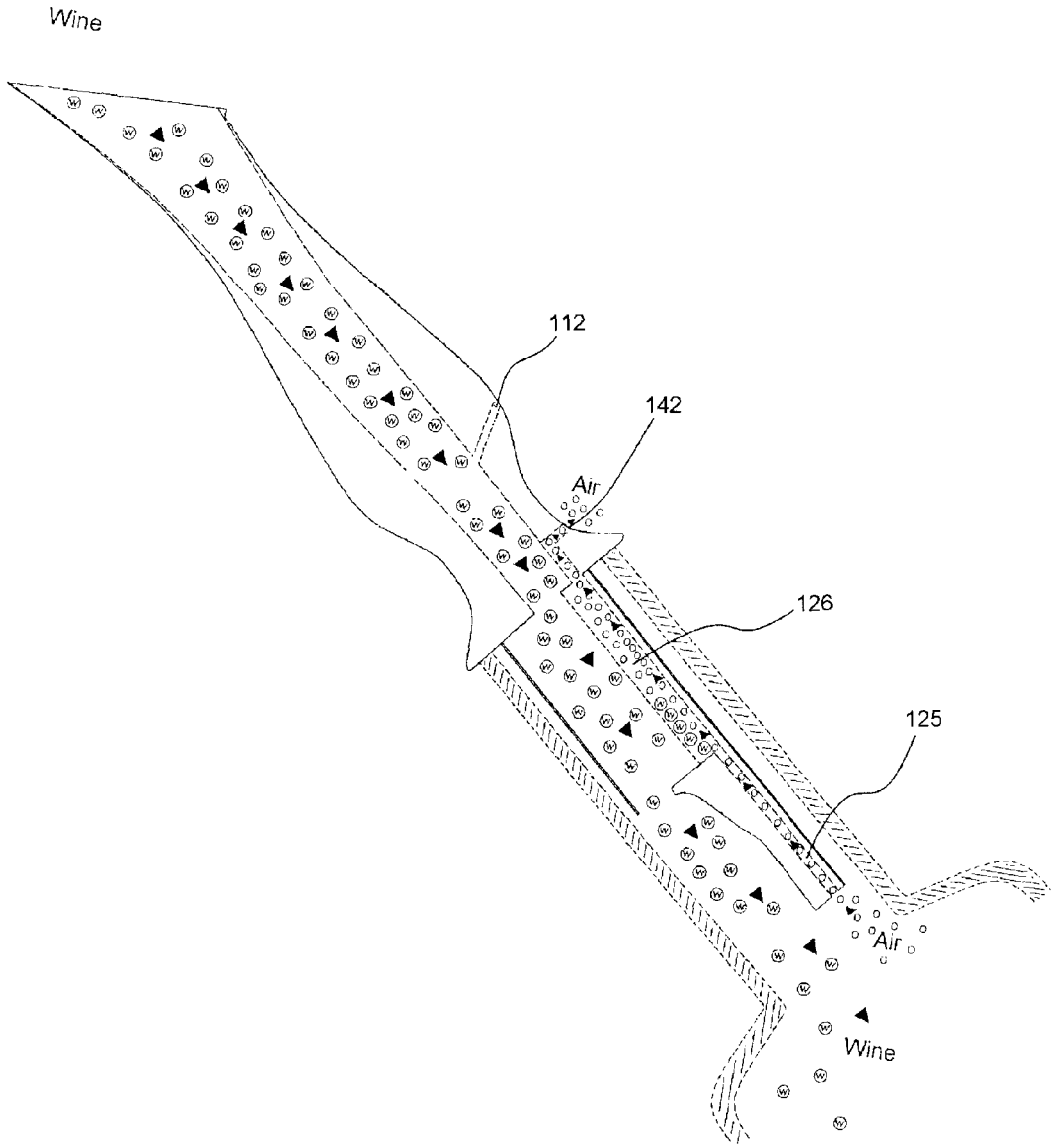
FIG. 4 is a lateral cross section view of the device as it is tilted up after a pour.
Figure 6:
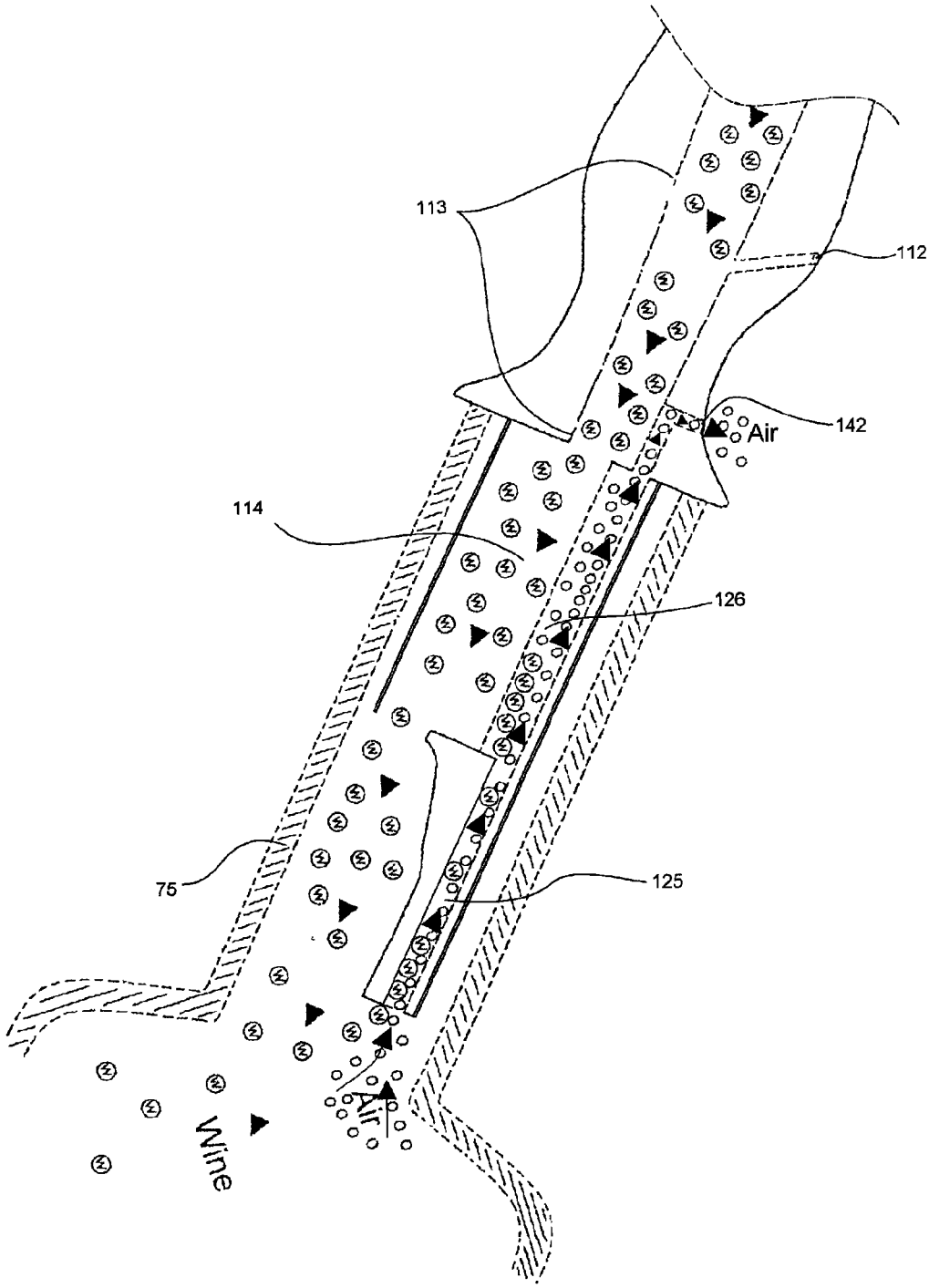
FIG. 6 is a magnified view of portions FIG. 4.

FIG. 4 is a lateral cross section view of the device as it is tilted up after a pour. FIG. 6 is a magnified view of portions FIG. 4. As the wine that did not complete its exit from the device during the pour returns to the bottle from the outflow section 50 and back into the bottle 75, air is forced into the ventilation tube 125 and the ventilation cavity and out through the ventilation port 142. During this process, liquid wine may also be drawn into the ventilation tube.

An important purpose for the ventilation cavity 126 is to allow the wine that has been drawn into the ventilation tube 125 to separate from the air and remain in the ventilation cavity 126 as the air exits the ventilation port 142. After the air pressure has equalized between the ventilation cavity 126 and the ambient air, the wine that has been drawn into the ventilation cavity 126 may then drain back into the bottle 75. This configuration greatly reduces the likelihood that wine will spill out of the ventilation port 142.

As shown in the figures, the location and orientation of the distal end of the ventilation tube 125 and the ventilation port 142 are preferably on the top of the liquid channel flow through the device. This configuration reduces the likelihood of liquid entering the ventilation tube 125 by allowing the liquid to flow into, and out of, the entry section 114, below the ventilation tube 125.

Figure 7:
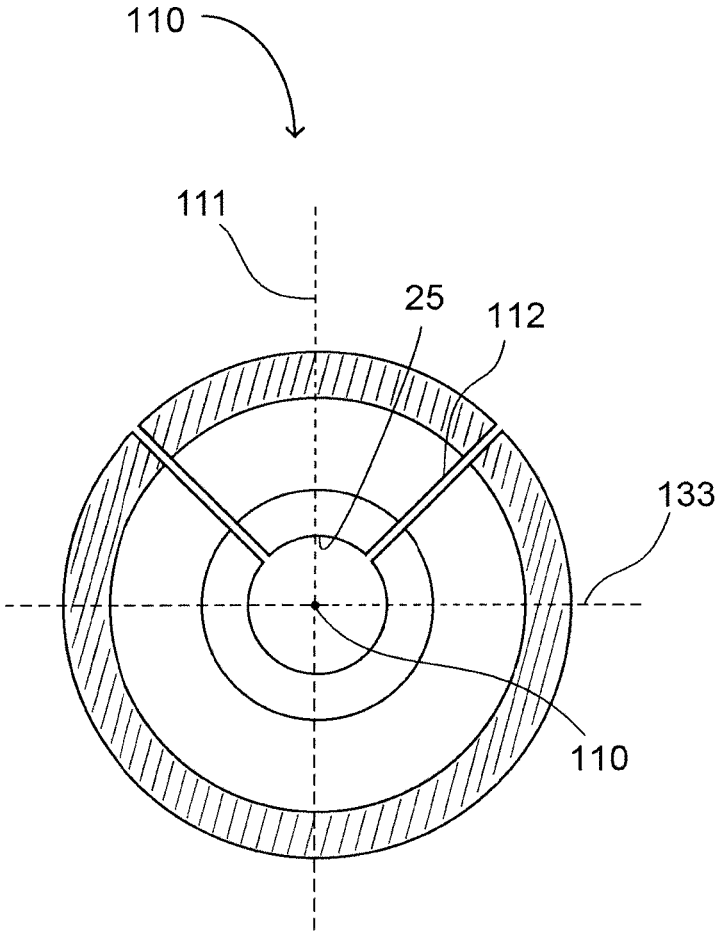
FIG. 7 is an end view from the outflow at the intersection of axes 110, 111 and 133 of the embodiment of FIG. 1.

With reference to FIG. 7, an embodiment of the present invention is shown, having central axis 110 and vertical axis 111 and lateral axis 133. The constricted intermediate section 113 is fluidly connected to the entry section 114 at the rim 25, and centered about central axis 110. The rim 25 is formed by the intersection of the narrow end of constricted intermediate section 113 and the top of entry section 114. The rim 25 of entry section 114 is preferably bowl-shaped or substantially flat, so as to form a sharp, nearly perpendicular, angle with constricted intermediate section 113, preferably in the range of 90-120 degrees. This arrangement decreases the likelihood of vortex formation as the liquid enters constricted intermediate section 113.

The complex orientation of lateral tubes 112 with respect to axes 110, 111 and 133 is shown. Lateral tubes 112 should be set at approximately 45 degrees with respect to axes 133 and 111 and intersect constricted intermediate section 113 above axes 110 and 133 relating to the flow of liquid. For best results, the lateral tubes 112 are preferably angled forward towards the exit end 54, at approximately 45 degrees with respect to the vertical axis 111, with the lateral tubes angled from the constricted intermediate section to the exterior of the device as shown in FIGS. 2-4. However, lesser angles could also be used.

The foregoing exemplary embodiments are described as having two lateral tubes 112 at their intersection with constricted intermediate section 113. For example, since the device of the present invention relies entirely on earth's gravitational force to initiate flow of the liquid through it, preferably one or more of lateral tubes 112 should not be located at or near the underside of the liquid channel flow through the device 110. Rather, they should be located along the sides of the flow, preferably at acute angles relative to both the central axis 110, vertical 111, and to lateral axis 133 as shown in FIG. 7.

It is also recognized that the device is operative with one or more lateral tubes 112. Moreover, the lateral tubes need not be symmetrically arranged, but may be positioned in a variety of ways, as desired for aesthetic purposes or otherwise. Therefore, in alternative embodiments of the present invention (not shown), there are one or more lateral tubes, each oriented so as to form an acute angle relative to the axes of the intermediate constricted intermediate section. The acute angles may or may not be substantially the same.

Additionally, while the preferred embodiment of the present invention is described with respect to the introduction of air into wine, the device may be utilized to facilitate introduction of any fluid into another fluid, the fluids being liquid or gaseous. The preferred embodiment is contemplated to function at ambient pressures; however, the device may also be operated under pressure. Moreover, it is possible to utilize the multiple lateral tubes of the present invention to introduce multiple fluids into a single fluid flowing in the device.

The device is preferably composed of a transparent plastic material such as an engineered thermoplastic material, which yields a robust structure while allowing one to view the liquid as it is poured through the device. However, the device is readily fabricated using other materials that are known in the art, such as glass or metal.

In other alternative embodiments of the present invention (not shown), the entry section may have any shape that serves to funnel liquid towards the intermediate constricted intermediate section, such as an inverted pyramid-type shape. Likewise, the outflow section may be substituted for an alternative shape of generally increasing cross-sectional area from top to bottom, such as horn-shaped, tetrahedral or pyramidal.

Information as herein shown and described in detail is fully capable of attaining the above-described object of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, in which reference to an element in the singular is not intended to mean "one and only one" unless explicitly so stated, but rather "one or more."

All structural and functional equivalents to and combinations of the elements of the above-described preferred embodiment and additional embodiments that are known to those of ordinary skill in the art are hereby expressly incorporated by reference and are intended to be encompassed by the present claims. However, it should be readily apparent to those of ordinary skill in the art that various changes and modifications in form, apparatus material, and fabrication material detail may be made without departing from the spirit and scope of the invention as set forth in the appended claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. No claim herein is to be construed under the provisions of 35 U.S.C. §112, sixth paragraph, unless the element is expressly recited using the phrase "means for."

Industrial Applicability

The present invention applies to devices for aerating a liquid, such as wine, as it is poured from a bottle.

What is claimed is:

1. An apparatus for mixing two fluids, the apparatus comprising:
   a. a conduit through which a first fluid flows, the conduit having an air ventilation port and a constricted intermediate region;
   b. a plurality of lateral tubes for introducing a second fluid substantially at the constricted intermediate region, at least two of the lateral tubes being formed at acute angles relative to the direction of flow of the first fluid through the constricted intermediate region and with respect to central, vertical and lateral axes thereof; and
   c. an air ventilation tube, having first and second ends, the first end fluidly coupled to the air ventilation port for introducing air into a bottle and for preventing leakage from the lateral tubes during use, wherein the ventilation tube includes a ventilation tube cavity, for capturing backwash of the first fluid as pouring is terminated, wherein the diameter of the ventilation tube cavity is greater than the diameter of either the air ventilation port or the second end of the ventilation tube.

2. The apparatus of claim 1 wherein the volume of the ventilation tube cavity is selected to capture the backwash of the first fluid as pouring is terminated.

3. The apparatus of claim 1, wherein the angles of plurality of lateral tubes are approximately 45 degrees with respect to the central, vertical, and lateral axes.

4. A conduit apparatus, having a top and a bottom with respect to a central and lateral axes thereof, for pouring and aerating liquid flowing from a bottle comprising:
   a. an outflow section;
   b. an entry section, for insertion into a bottle opening;
   c. a conduit in fluid communication with the outflow and entry sections, having a constricted intermediate region intersected by one or more lateral tubes for introducing air into the conduit thereat, the lateral tubes being formed at a substantially acute angle relative to the direction of liquid flow through the intermediate region and with respect to central, and lateral axes thereof;
   d. an air ventilation tube, having first and second ends, the first end fluidly coupled to an air ventilation port for introducing air into the bottle and for preventing leakage from the lateral tubes during use; and
   e. a ventilation tube cavity located within the air ventilation tube, wherein the diameter of the ventilation tube cavity is greater than the diameter of either the ventilation port or the second end of the ventilation tube.

5. The apparatus of claim 4, wherein the outflow end includes an outlet cover for covering the outflow section when the apparatus is not in use.

6. The apparatus of claim 4, wherein the entry section includes a tapered portion having a liquid seal coating for fitting into the mouth of a bottle and forming a liquid seal therewith.

* * * * *